United States Patent [19]

Slack

[11] Patent Number: 4,864,102

[45] Date of Patent: Sep. 5, 1989

[54] MINIATURE ADJUSTABLE THERMOSTAT WITH INTEGRAL OVER-TEMPERATURE PROTECTION

[75] Inventor: Douglas J. Slack, Smithfield Plains, Australia

[73] Assignee: Texas Instruments Incorporated, Dallas, Tex.

[21] Appl. No.: 125,270

[22] Filed: Nov. 25, 1987

[51] Int. Cl.[4] ..... H05B 1/02; H01H 37/36; H01H 37/76

[52] U.S. Cl. ..... 219/253; 337/3; 337/4; 337/403

[58] Field of Search ..... 337/3, 4, 112, 113, 337/380, 381, 403, 404, 405, 407; 219/251, 252, 253

[56] References Cited

U.S. PATENT DOCUMENTS 4,433,231 2/1984 Balchunas ..... 337/407

FOREIGN PATENT DOCUMENTS 604189 8/1960 Canada ..... 219/253
509808 2/1975 Fed. Rep. of Germany ..... 219/253

*Primary Examiner*—H. Broome
*Attorney, Agent, or Firm*—James P. McAndrews; John A. Haug; Melvin Sharp

[57] ABSTRACT

A thermally responsive control especially for a clothes iron combines an adjustable, temperature-regulating thermostat and an over-temperature control for limiting maximum temperature levels on a plastic mounting bracket where the over-temperature control also protects the mounting bracket against damage from overheating.

5 Claims, 2 Drawing Sheets

MINIATURE ADJUSTABLE THERMOSTAT WITH INTEGRAL OVER-TEMPERATURE PROTECTION

BACKGROUND OF THE INVENTION

This invention relates to an improved temperature regulating device or thermostat and in particular it relates to a miniature electric thermostat used to regulate or control the temperature of a clothes iron or similar heater systems.

Current practice in thermostats of this type is to compose the thermostat of a sandwich of ceramic insulators, metal switch elements and a metal bracket.

Ceramics are required for the stability of high temperatures, especially for non-periodic excursions of high temperature sometimes occuring during initial calibration. The construction necessitates many separate pieces and an assembly technique that is difficult to automate.

Current practice also is to build into clothes irons or other similar appliances, a separate over-temperature "one shot" type switch to limit the maximum temperature of the appliance. This is a safety feature, and in current practice the temperature control thermostat and over-temperature are two separate controls mounted at different places in the appliance.

BRIEF SUMMARY OF THE INVENTION

The object of the present invention is to provide an improved assembly which will be more readily manufactured and applied to a clothes iron or the like and will act both to control the temperature of the sole plate of the iron as well as safeguarding against any over heating which is not controlled by the thermostat.

The invention comprises an assembly which integrates the temperature control thermostat and the over-temperature switch and is fabricated with an easy-to-assemble "bracket" of organic or plastic material in place of a sandwich, or stack of ceramic insulators, the proposed combination using high temperature plastic for the bracket, but has the advantage that an integral over-temperature switch limits the maximum temperature that the plastic of the bracket would be exposed to, assuring additional stability.

The thermostat itself may be a creep or snap type, and the over-temperature switch is preferably a bimetal type, or a "change-of-phase type" such as an eutectic device, or other one shot device.

In some applications a manually resettable over-temperature device could be used.

DESCRIPTION OF THE DRAWINGS

To enable the invention to be fully understood an embodiment thereof will now be described with reference to the accompanying drawings in which.

DESCRIPTION OF THE PREFERRED EMBODIMENTS

Figure 1:
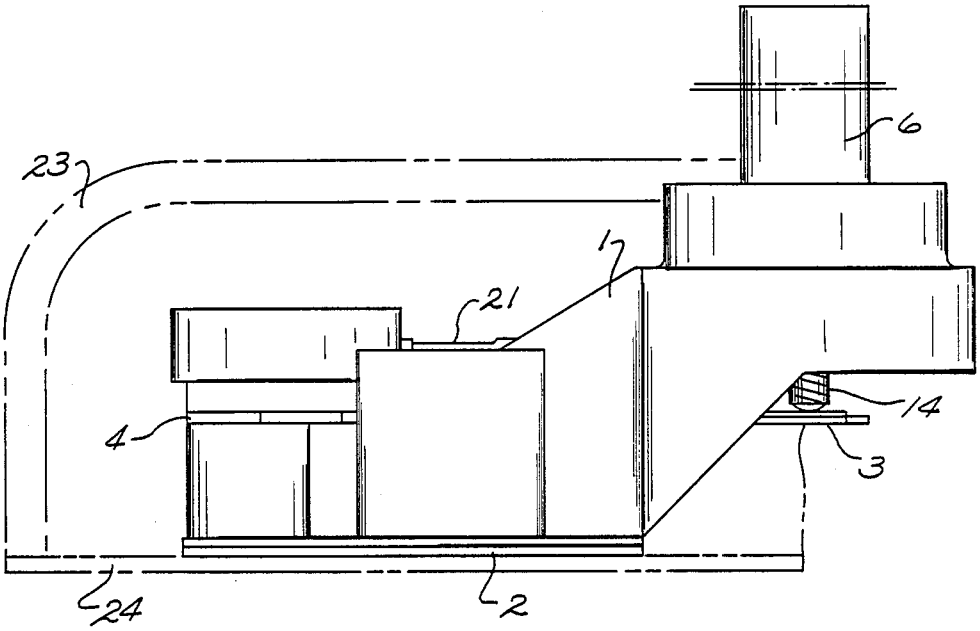
FIG. 1 in side elevation a thermostatic switch according to the invention.

According to a preferred embodiment as shown in the drawings, the temperature regulating device of the invention comprises a bracket 1 formed of a desired, low-cost, temperature-resisting organic or plastic material. The bracket is mounted by means of a rivet 1*a* or other conventional means (shown in broken lines in FIG. 2) on a clothes iron 23 having a sole plate 24 (shown in broken lines in FIG. 1). The sole plate is adapted to be heated in conventional manner by a heating element (shown diagrammatically at 25 in FIG. 3) energized from a power source (shown diagrammatically by the line terminal 26 in FIG. 3). The bracket carries a thermally-responsive bimetallic strip 2 so that when the bracket is mounted on the iron, the bimetallic strip directly contacts the sole plate 24 and is adapted to flex in response to change in sole plate temperature. A conventional switch blade 3 is fixed at one end 4 to the bracket 1 and has a central tongue part 3.1. A pin 22 is secured to the bimetallic strip and is adapted to transfer a force representative of the sole plate temperature to the tongue 3.1 as the bimetallic strip flexes. The opposite free end of the switch blade 3 is also in engagement with a temperature adjusting means 5. The temperature adjusting means comprises a shaft 6 which is rotatable in the bracket 1 and which has a cam 7 associated with a cam surface 8 on the bracket so that rotation of the shaft adjusts application of a force to the free end of the switch blade by the screw 14. The shaft 6 is hollow and the screw 14 is rotatably adjustable therein independent of rotation of the shaft 6. A conventional snap action blade 12 which is adapted to be overbalanced by its loading blade 13 in conventional manner is secured at one end to the free end of the switch blade 3 and has its loading blade secured to the tongue 3.1 of the switch blade in conventional manner. A contact 9 is carried on the snap action blade 12 to be engaged and disengaged with a contact 20 carried on another switch blade 21 which is also mounted on the bracket 1. A contact 16 is supported insulatedly on the bracket 1 and a terminal 18 is connected to the contact 16. A terminal 19 is also provided on the switch blade 3.

Figure 4:
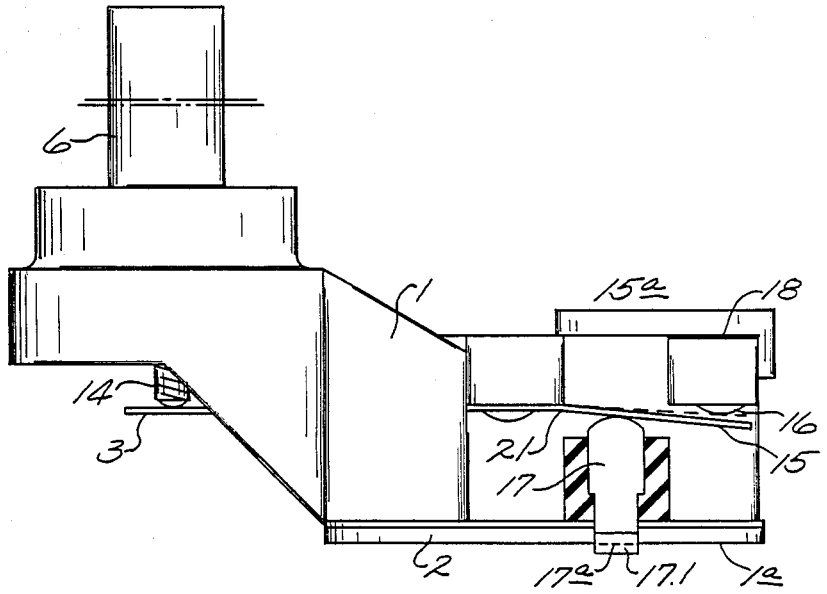

The temperature regulating device of the invention also includes an additional thermally responsive means for protecting the clothes iron or other appliance against occurrence of an over-temperature condition. In the preferred embodiment shown in the drawings, a tail portion 15 on the switch blade 21 is normally biased to move away from the contact 16 but is urged into a closed circuit position engaging the contact 16 by action of a fusible link pin 17 as indicated by the broken line 15*a* in FIG. 4. The fusible link pin is slidable in the bracket 1 and is adapted to engage the sole plate of the clothes iron when the bracket 1 is mounted on the iron thereby to press the fusible link pin end 17.1 flush with the bottom of the bracket as indicated by the dotted line 17*a* in FIG. 4, whereby the tail portion 15 of the blade 21 is engaged with the contact 16. The end 17.1 of the fusible link pin engages the sole plate 24 in closely spaced relation to the bimetallic strip 21. The end portion 17.1 of the pin is formed of a metal material or the like having a melting point selected to melt when a predetermined over-temperature condition occurs in the sole plate, that over-temperature level being selected to prevent damage to the organic bracket material when that over-temperature condition occurs.

Figure 2:
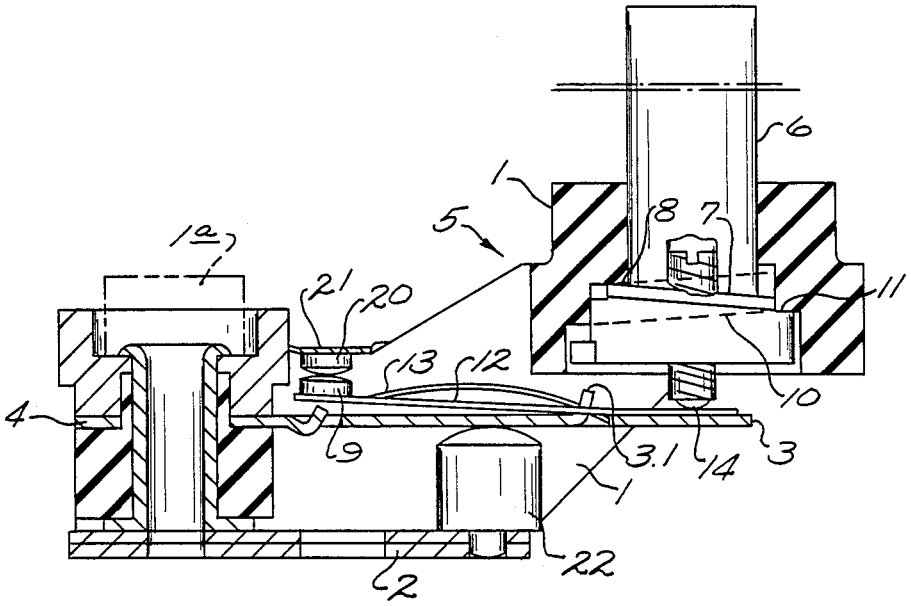
FIG. 2 a transverse section to show the general arrangement of the components.
Figure 3:
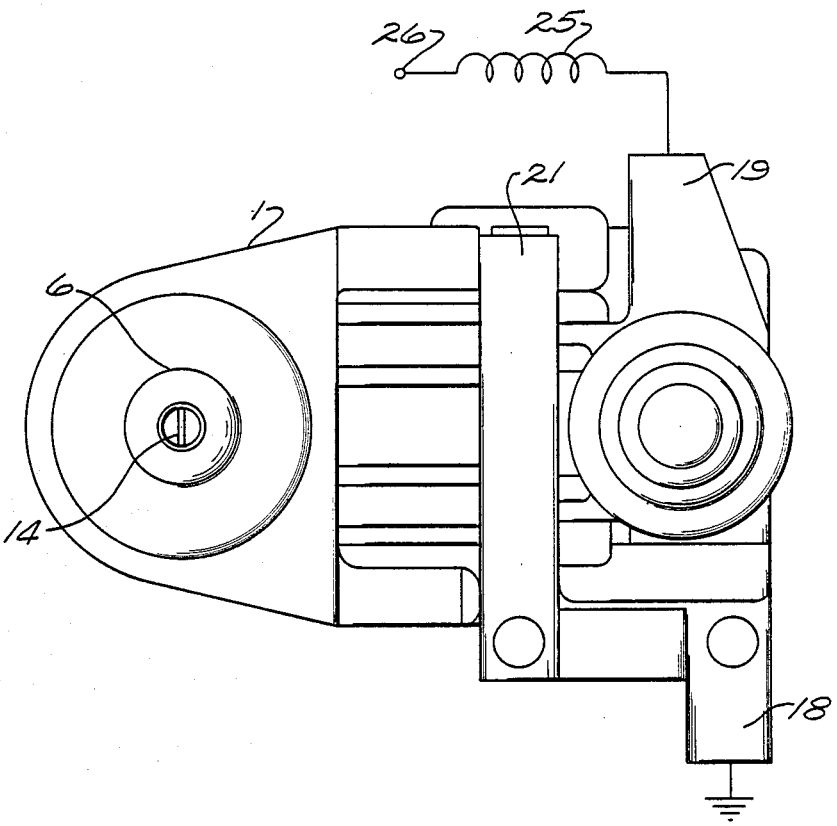
FIG. 3 is a plan, and FIG. 4 an elevation showing the switch from the side opposite to that shown in FIG. 1.

In that arrangement, the contacts 9 and 20 are normally engaged in a closed circuit position as shown in FIG. 2 for energizing the heater element 25 from the power source 26. Rotation of shaft 6 selects the temperature adjusting force applied to switch blade 3 and selects the operating temperature of the iron so that flexing of the bimetallic strip 2 in response to occurrence of the selected operating temperature in the sole plate causes snap-acting movement of the blade 12 to separate contact 9 from contact 20 to deenergize the heater. When the sole plate then cools, bimetallic strip movement reengages the contacts to reenergize the heater. Adjustment of the screw 14 permits calibration of those temperature regulating means. However, when a predetermined over-temperature condition occurs in the sole plate due to a fault condition or the like, the end 17.1 of the fusible link pin melts in prompt response to the over-temperature condition to permit the tail portion 15 of the blade 21 to move away from contact 16 in response to its normal bias to interrupt the heater energy circuit, thereby to protect the organic material of the mounting bracket from damage due to the over-temperature condition.

The advantages of this construction are:

(1) The clothes iron assembler would only mount, connect and calibrate a single control thermostat bracket over-temperature switch unit; thus eliminating assembly, mounting and connecting a separate over-temperature switch.

(2) The thermostat/over-temperature unit would inherently allow the temperature control thermostat and the over-temperature switch to sense the appliance temperature at nearly the same location. This would offer better overall control and simpler calibration of the over-temperature device (current practice is to mount the over-temperature switch in a location remote from the control thermostat).

(3) The overall cost would be less for the appliance manufacturer.

(4) The plastic bracket on the temperature control thermostat could allow the use of a low cost cam type means for achieving temperature adjustment.

Present designs using metal brackets use expensive screw mechanisms for achieving temperature adjustment. The present assembly therefore further reduces the cost.

It should be understood that although particular embodiments have been described by way of illustrating the invention, this invention includes all modifications and equivalents of the disclosed embodiments falling within the scope of the appended claims.

I claim:

1. A temperature regulating device for an electrical heater for a sole plate in a clothes iron comprising means for mounting the device at a selected location on a sole plate, means on the mounting means for controlling energization of the heater, adjustable means mounted on the mounting means arranged to be thermally responsive to temperature in the sole plate at nearly the same location for regulating operation of the energization controlling means to provide a selected temperature in the sole plate at said location, and additional means mounted on the mounting means to be thermally responsive to temperature in the sole plate at said location for interrupting operation of the energization controlling means on the occurrence of a predetermined over-temperature in the sole plate at said location, the mounting means being formed of a material of an organic composition, and the predetermined over-temperature being selected for preventing damage to the organic material of the mounting means at said location on the sole plate during occurrence of the over-temperature.

2. A temperature regulating device for an electrical heater for a sole plate in a clothes iron according to claim 1 wherein said adjustable means comprises a bimetal member thermally responsive to temperature in a sole plate for regulating operation of the energization controlling means to provide a selected temperature in the sole plate at said location, and said additional means thermally responsive to temperature in the sole plate at said location for interrupting operation of the energization controlling means on the occurrence of a predetermined over-temperature in the sole plate is disposed in closely spaced, side-by-side abutting relation to the bimetal member of the sole plate in close heat-transfer relation thereto and to the organic material of the mounting means for preventing damage to the organic material of the mounting means during occurrence of the over-temperature.

3. A temperature regulating device according to claim 2 wherein the additional thermally responsive link comprises a fusible link means.

4. A temperature regulating device according to claim 3 wherein the fusible link means comprises a blade portion biased to a position opening a circuit for interrupting the energization controlling means, and a fusible link pin, the pin being slidably mounted in the mounting means to normally hold the blade portion in a position closing said circuit and having a portion thereof fusible when heated to said predetermined over-temperature for permitting the blade portion to move to the open circuit position in response to its bias.

5. A clothes iron having a sole plate at a selected location, an electrical heater for the sole plate, and a temperature regulating device for the heater comprising means mounting the device on the sole plate, means mounted on the mounting means for controlling energization of the heater, adjustable means mounted on the mounting means having a bimetal member thermally responsive to temperature in the sole plate at said location for regulating operation of the energization controlling means to provide a selected temperature in the sole plate at said location, and additional means thermally responsive to temperature in the sole plate at said location for interrupting operations of the energization controlling means on the occurrence of a predetermined over-temperature in the sole plate, said mounting means mounting the bimetal member to the adjustable means and the additional thermally responsive means in closely spaced, side-by-side abutting relation to the sole plate in close heat-transfer relation thereto and to the mounting means at said location, the mounting means being formed of an organic material, and the predetermined over-temperature being selected for preventing damage to the organic material of the mounting means during occurrence of the over-temperature.

* * * * *